United States Patent [19]

Zanow et al.

[11] 4,305,514

[45] Dec. 15, 1981

[54] PLATE-TYPE FRICTION DRAFT GEAR

[75] Inventors: Andrey L. Zanow, Cleveland, Ohio; Donald Willison, New Port Richey, Fla.

[73] Assignee: Midland-Ross Corporation, Cleveland, Ohio

[21] Appl. No.: 94,840

[22] Filed: Nov. 16, 1979

[51] Int. Cl.[3] ..... B61G 9/10

[52] U.S. Cl. ..... 213/43; 213/32 R

[58] Field of Search ..... 213/43, 223, 40 D, 32 R, 213/22, 37; 267/153

[56] References Cited

U.S. PATENT DOCUMENTS

| | | | |
|---|---|---|---|
| 3,150,782 | 9/1964 | Campbell et al. | 213/43 |
| 3,386,597 | 6/1968 | Willison et al. | 213/32 R |
| 4,076,129 | 2/1978 | Housman | 213/32 R |

*Primary Examiner*—Richard A. Bertsch

*Attorney, Agent, or Firm*—Harlan E. Hummer

[57] ABSTRACT

A high capacity plate-type friction draft gear is disclosed for utilization with railroad cars. The draft gear has a friction clutch mechanism with a special two-piece split spring seat, so that two individual spring forces can be exerted separately against the friction shoes to maintain operability of the friction clutch mechanism when the various plates become worn to the point of normal replacement.

14 Claims, 6 Drawing Figures

PLATE-TYPE FRICTION DRAFT GEAR

BACKGROUND OF THE INVENTION

The invention is particularly well suited for use in a high capacity plate-type friction draft gear as disclosed, for example, in U.S. Pat. No. 3,150,782 which describes a well known friction clutch mechanism that is comprised of a pair of movable friction plates that protrude from the open front end of the housing of the draft gear, a pair of tapered stationary friction plates located within the housing adjacent and inwardly of the movable friction plates, a pair of friction shoes positioned adjacent and inwardly of the stationary friction plates, and a plunger or friction wedge disposed between the friction shoes and a front follower which is located adjacent the front end of the housing. A one-piece, unitary spring seat is positioned between the friction clutch mechanism and metal coil springs which function to exert a force against the movable friction plates in the direction of the front follower. The friction wedge, as it moves rearwardly of the housing, is designed to wedge the friction shoes outwardly against the stationary friction plates which, in turn, increasingly frictionally engage the movable friction plates to greatly increase the resistance of the draft gear to buff or pull forces being applied against it by the car coupler through the front follower or yoke to which the coupler is attached, as the front follower and protruding ends of the movable friction plats come into contact.

Moderate amounts of wear to the components of the friction clutch mechanism of existing plate-type friction draft gears can cause an abrupt and total loss of dynamic and static frictional capacity which may result in substantial car damage and possibly cause train derailments resulting from exceedingly high dynamic train forces, e.g. about 600,000 pounds, created by unsatisfactory cushioning of the run in and out of free train slack.

Loss of frictional capacity occurs when moderate wear reduces the thickness of the movable and stationary friction plates and the size of the friction shoes and wedge of conventional plate-type friction draft gears. Such wear causes the friction shoes to be expanded and moved outwardly towards the front follower on the wedge by the spring forces which also force the movable friction plates and spring seat outwardly until the movable friction plates simultaneously abut the front follower and spring seat. Continued wear causes the friction shoes to move still further outwardly on the wedge to create a space between the wedge and front follower while the movable friction plates remain in contact with the front follower and spring seat. This causes the train forces to be transmitted directly to the springs through the movable friction plates and spring seat, thereby bypassing the friction clutch mechanism to cause an abrupt and total loss of frictional capacity of the draft gear.

It can be appreciated from the above that it is extremely important to continually monitor the wear of various parts or plates of plate-type friction draft gears presently on the market. This is done by constantly measuring the space between the front follower and adjacent protruding ends of the movable friction plates. The draft gear is rebuilt when the spacing decreases to a certain undesirable level. If not rebuilt at this point, the friction clutch mechanism becomes inoperable for increasing the frictional resistance to movement of the movable friction plates. Thus, the overall high resistance output capability of the draft gear is seriously affected. The invention is directed to an improved friction clutch mechanism for maintaining the draft gear in an operable condition even when the parts of the mechanism become worn to the point of replacement.

Briefly stated, the invention is in a plate-type friction draft gear having a friction clutch mechanism comprising a friction wedge, a pair of friction shoes, a pair of stationary friction plates, and a pair of movable friction plates which protrude from the open front end of the housing and terminate in spaced relation from a front follower which is in contact with the friction wedge. A two-piece split spring seat is provided between the friction clutch mechanism and the spring mechanism that is employed within the housing to exert, through the split spring seat, separate spring forces outwardly against the friction shoes and movable friction plates in the direction of the front follower to maintain the friction clutch mechanism operable by keeping the parts thereof in frictional engagement.

U.S. Pat. No. 3,386,597 shows and describes the use of a split spring seat, but in connection with a completely different type draft gear, which does not utilize movable friction plates for increasing the resistance of the draft gear, and for a totally different purpose; namely, to keep the friction clutch of the draft gear from freezing up or becoming locked against the housing after partial or full compression of the draft gear.

DESCRIPTION OF THE DRAWING

The following description of the invention will be better understood by having reference to the annexed drawing, wherein.

DETAILED DESCRIPTION OF THE DRAWING

Figure 1:
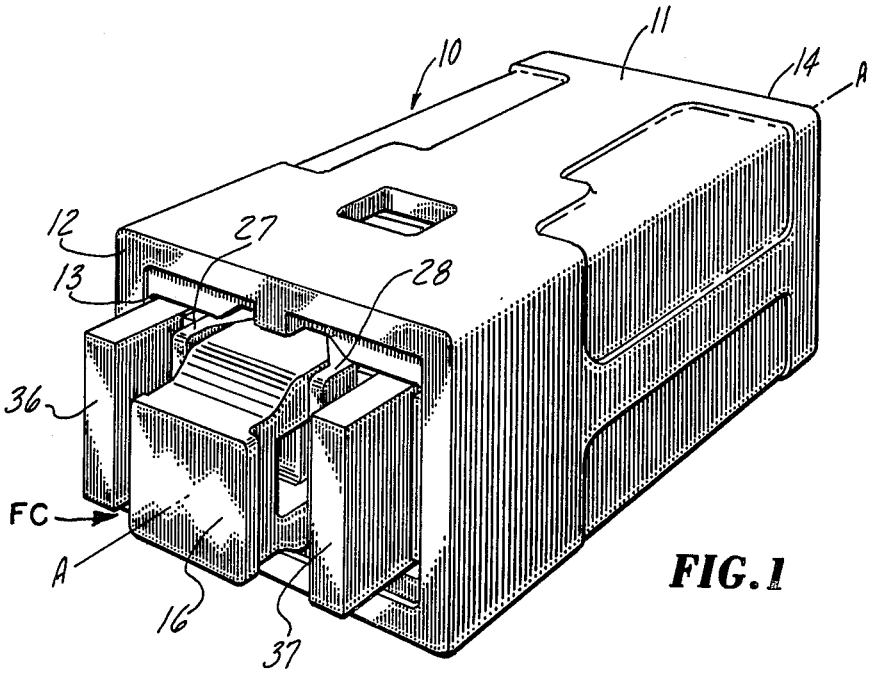
FIG. 1 is a perspective view of a plate-type friction draft gear made in accordance with the invention.
Figure 4:
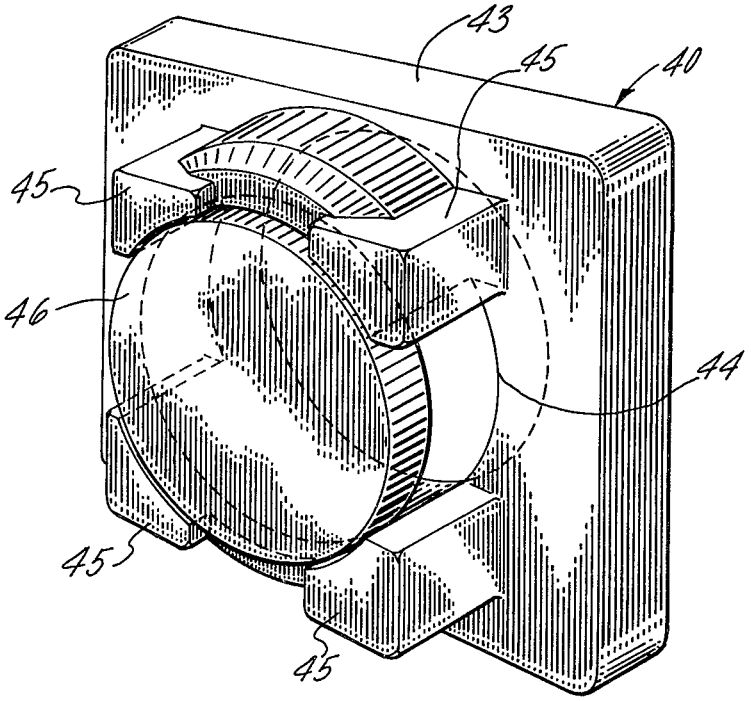
FIG. 4 is a perspective view of the split spring seat of the draft gear.

With general reference to the drawing for like parts and particular reference to the embodiment of FIGS. 1–4, there is shown a plate-type friction draft gear 10 used in connection with railroad cars. The draft gear 10 comprises a rigid metal housing 11 having a front end 12 with an opening 13 therein and a back end 14 which is generally closed and longitudinally spaced from the front end 12 which is closest a front follower 15 against which the butt end of the shank of a car coupler normally rests. The car coupler is attached to a yoke which conventionally surrounds the draft gear and generally coacts with the back end 14 of the housing 11 when the car coupler is in pull.

A friction clutch FC, provided to increase the resistance capacity of the draft gear 10, comprises a wedge 16 that is centrally disposed within the housing 11 and protrudes from the front opening 13 for engagement with the front follower 15. The plunger or friction wedge 16 is provided with a pair of tapered wedging surfaces 17,18 which are angularly disposed to a plane containing the longitudinal axis A-A of the housing 11 and which converge in the direction of the back end 14 of the housing 11. The friction wedge 16 has a pair of outstanding lugs 19,20 which are designed to interlockingly engage a pair of adjacent stops 21,22 in the front end 12 of the housing 11 to keep the components of the draft gear 10 within the housing during transportation of the draft gear 10. The friction wedge 16 is optionally arranged to abut an adaptor 23 for seating a coil spring 24 that can be provided to exert against the friction wedge 16, a force longitudinally of the housing 11 in a direction away from the back end 14 of the housing 11 to help prevent the friction wedge 16 from becoming frictionally frozen or locked-up with an adjacent part of the draft gear 10.

The wedging surface 17,18 of the friction wedge 16 slidably and wedgingly engage matingly sloped surfaces 25,26 of a pair of adjacent friction shoes 27,28 which are disposed laterally outwardly of the friction wedge 16 and which are movable longitudinally and laterally of the housing 11 relative to the longitudinal axis thereof, during relative movement of the friction wedge 16 and the back end 14 of the housing 11 towards each other when an attached coupler is in buff or pull. The friction shoes 27,28 are provided with another pair of slightly tapered wedging surfaces 29,30 which diverge inwardly from the first set of wedging surfaces 25,26 in the direction of the back end 14 of the housing 11. The friction shoes 27,28 are each provided with at least one rearwardly facing abutment 31 which lies in a plane which is angularly disposed preferably at a right angle to the longitudinal axis A-A of the housing 11.

The wedging surfaces 29,30 of the friction shoes 27,28 slidably and wedgingly engage a pair of matingly sloped wedging surfaces 32,33 of a pair of adjacent, abutting substantially stationary friction plates 34,35 which are disposed within the housing 11 laterally outwardly of the friction shoes 27,28 and which are designed to increasingly frictionally engage a pair of adjacent abutting movable friction plates 36,37 that are longitudinally slidable in recesses formed between the stationary friction plate 34,35 and a pair of laterally spaced, substantially stationary wearplates 38,39 which, if desired, may be an integral part of the housing 11. The movable friction plates 36,37 terminate in spaced relation from the front follower 15 and are designed to bear against or engage the front follower 15 upon relative movement between the front follower 15 and housing 11. The stationary friction plates 34,35 and wearplates 38,39, so-called because they are mounted within the housing 11 for restricted movement longitudinally of the housing 11, are free to move laterally relative to the longitudinal axis of the housing 11. It can be appreciated from a study of FIG. 2 that the stationary friction plates 34,35 and wearplates 38,39 will increasingly compressively engage the adjacent movable friction plates 36,37 as the friction shoes 27,28 are urged rearwardly toward the back end 14 of the housing 11 by the friction wedge 16 during relative movement of the front follower 15 and housing 11 towards each other when an attached car coupler is in pull or buff.

A split spring seat 40 is provided to seat two separate sets 41,42 of springs which are designed to exert independent spring forces outwardly against the friction shoes 27,28 and movable friction plates 36,37 in a direction longitudinally of the housing 11 and away from the back end 14 of the housing 11 to return the parts of the friction clutch FC, i.e. the wedge, shoes and plates, to their normal rest positions, when the pull or buff forces upon the draft gear 10 are removed, and to insure that a spring force is always exerted outwardly against the friction shoes 27,28 to maintain the friction clutch FC operable by keeping the parts of the friction clutch in frictional engagement even when the parts are worn to the point of normal replacement.

The split spring seat 40 comprises a rectangular spring seat plate 43 with a centrally disposed circular opening 44 therein. The spring seat plate 43 engages the movable friction plates 36,37 and is provided with a discontinuous arcuate flange, such as a plurality of outstanding fingers 45 arcuately spaced around the opening 44 to simultaneously engage the adjacent rearwardly facing abutments 31 of the friction shoes 27,28. In some cases, the individual flanges 45 can be joined to form a continuous circular flange 45 around the opening 44, depending on the design of the adjacent components. A second spring seat plate in the form of a planar disc 46 with a centrally disposed opening 47, which opening is mandatory in the embodiment of FIGS. 5,6 and optional in the embodiment of FIGS. 1–3 when a center spring 24 for forcing the friction wedge 16 outwardly is used, is positioned within the circular opening 44 formed in the spring seat plate 43 and also rests against the adjacent rearwardly facing abutments 31 of the friction shoes 27,28 inwardly of the places on the abutments 31 which the fingers 45 of the outer spring seat plate 43 engage. The first set 41 of springs comprises four similar coil springs which are positioned between the four corners of the rectangular spring seat plate 43 and the back end 14 of the housing 11 to load the spring seat plate 43 and force it outwardly against the movable friction plates 36,37 and the friction shoes 27,28. The second set 42 of springs comprises a single coil spring positioned between the spring seat disc 46 and the back end 14 of the housing 11 to separately load the spring seat disc 46 and force it outwardly against the friction shoes 27,28 free of the other spring seat plate 43. The spring force exerted outwardly against the spring seat disc 46 is sufficient to maintain the friction clutch FC operational and in frictional engagement even when the parts are worn to replacement, and to provide satisfactory initial compression to stiffen the parts against movement from low train forces exerted against the draft gear 10, thereby preventing undue movement and consequent wear of the parts and to provide satisfactory frictional capacity when spring 42 ceases to activate the friction clutch because of worn parts.

The spring means has been described in relation to metal coil springs, although it should be understood that any suitable spring means, such as resilient elastomeric cushion pads described, for example, in U.S. Pat. No. 2,686,667, and hydraulic cylinders described, for example, in the aforementioned 3,150,782 patent, alone or in combination with each other or the metal coil springs, if desired, can be employed without detracting from the spirit of the invention, since, in some instances, it may be more economical to use a number of resilient rubber cushion pads in lieu of the metal coil springs.

Figure 5:
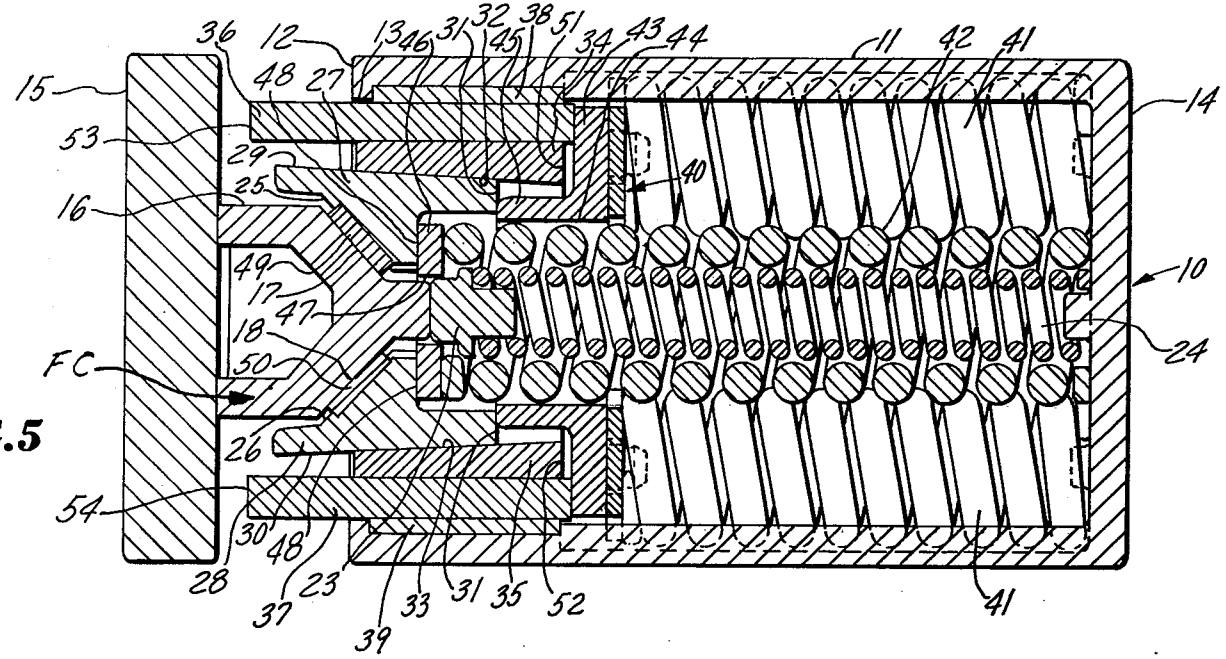
FIG. 5 is a plan view of another embodiment of the draft gear in cross-section.
Figure 6:
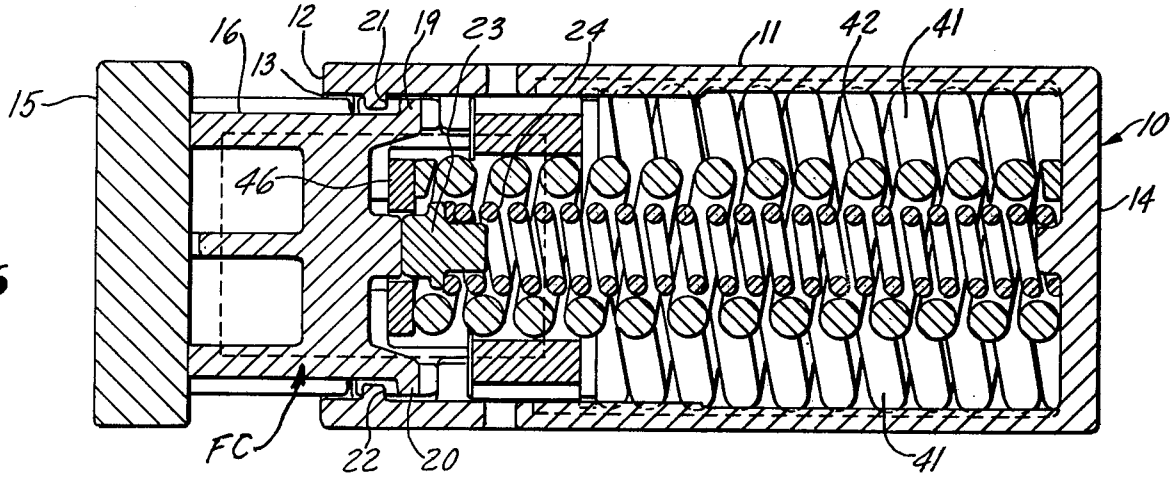
FIG. 6 is a side view of the embodiment of FIG. 5 in cross-section.

It can be appreciated from a study of the drawing that the embodiments of FIGS. 2, 3 and 5, 6 are essentially the same, except for a few minor changes. For example, the friction shoes 27,28 of FIGS. 5,6, are each provided with an additional rearwardly facing abutment 48 which is parallel to, and in spaced relation from the other, most rearward facing abutment 31 which, in this instance, is designed to accommodate only the outstanding fingers 45 of the spring seat plate 43. The intermediate abutments 48 on the friction shoes 27,28 are provided to seat the spring seat disc 46 which is forced outwardly beyond the free distal ends of the fingers 45 by a longer, single coil spring 42 which has a greater spring capacity and therefore provides greater stiffening of the parts against movement in response to forces initially applied against the draft gear 10. The spring seat plate 43 and disc 46 may be coplanar. However, this would shorten the length of the single coil spring 42 and consequently lessen the stiffening forces of the parts against movement from initial forces imparted to the draft gear 10.

A pair of similar, anti-seizure bearing blocks 49,50 are, optionally, recessed in the wedging surfaces 25,26 of the friction shoes 27,28 and extend therefrom for sliding, wedging engagement with the adjacent wedging surfaces 17,18 of the friction wedge 16. The bearing blocks 49,50 are provided, if needed, to decrease the frictional forces between the friction wedge 16 and friction shoes 27,28, and are composed of relatively non-seizing material, such as brass, whereas the friction wedge 16 and shoes 27,28 are composed of steel.

As previously described, the split spring seat is designed to maintain substantial frictional capacity even after the parts of the friction clutch are worn to condemning limits or to the point of replacement. As noted previously, when existing plate-type friction gears wear to this point, all frictional capacity is lost. With this new concept, only part of the frictional capacity is lost. When the draft gears are new and unworn, the train forces are transmitted through the friction clutch against the resistance of all the springs to develop maximum capacity. When the friction clutch parts wear to beyond condemning limits, the shoes will be expanded and moved outwardly on the wedge to cause spring seat 43 to move outwardly until the movable friction plates abut the front follower. At this point, a portion of the train forces will continue to be transmitted through the friction clutch against the resistance of the center spring group to create substantial frictional capacity while the remainder of the train force will be transmitted via the movable sliding plates and split spring seat to the corner group of springs.

Figure 2:
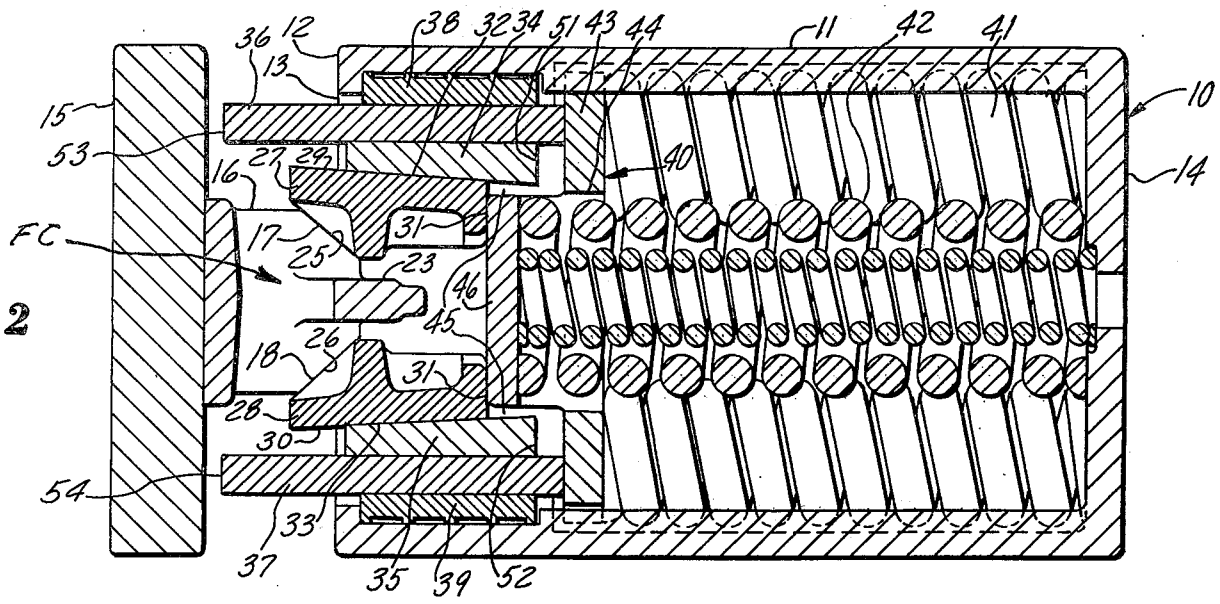
FIG. 2 is a plan view of the draft gear in cross-section.
Figure 3:
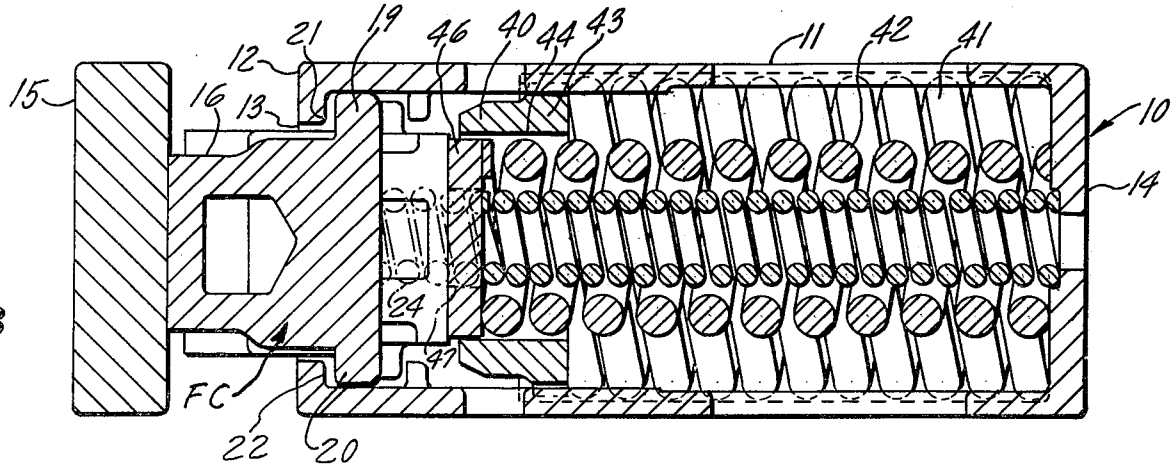
FIG. 3 is a side view of the draft gear in cross-section.

The friction clutch and spring groupings of FIGS. 1, 2, 3, 5 and 6 are similar and will function as described above. FIGS. 2 and 3 show a shorter center spring group 42 which is optimized for lowest cost. FIGS. 5 and 6 show a longer center spring which is optimized for maximum capacity and seats on the friction shoes substantially forward of the corner spring groups. The longer spring permits the use of higher capacity springs. The inner coil of the center spring groups can either be designed to seat directly on the friction wedge, as shown optionally in FIG. 3 and as shown in FIGS. 5 and 6 to maximize friction clutch release capability, or it can be designed to transmit force to the friction shoes as shown in FIG. 2, to optimize frictional capacity of the draft gear.

Thus, there has been described a unique snubbing, impact force reducing, or force resisting device which is especially useful as a high capacity plate-type friction draft gear on a railroad car. A unique split spring seat is used in the draft gear so that the spring force of the inner or center spring group will be independently asserted against the friction shoes to prevent malfunctioning of the draft gear even after the outer spring group has been neutralized by excessive wear of the parts of the friction clutch. The spacing between the distal ends of the movable friction plates and adjacent front follower is not as critical as with other prior art designs, and the draft gear will continue to function should this clearance be reduced beyond the point where similar draft gears without split spring seats will malfunction.

It is preferable that the spring forces exerted outwardly against the friction wedge through the split ring seat be simultaneous even when the draft gear is unloaded. In some designs, the spring forces against the spring seat plate farthest from the longitudinal axis of the draft gear, may come into play momentarily after the draft gear is placed under a load. Even in such cases, the spring forces generally work together substantially simultaneously upon the friction wedge through the split spring seat.

What is claimed is:

1. A force resisting device such as a plate-type friction draft gear comprising:

(a) a housing having a longitudinal axis and a pair of opposing ends spaced along said axis, one of the ends being the front end of the housing and the other of the ends being the back end of the housing;

(b) a pair of movable friction plates disposed within the housing and protruding from the front end thereof, the friction plates being movable along generally parallel axes which are parallel to the longitudinal axis of the housing;

(c) a pair of friction shoes disposed within the housing inwardly of the friction plates towards the longitudinal axis of the housing, the shoes being movable laterally and longitudinally of the housing;

(d) separate means interposed between each of the shoes and adjacent friction plate for increasingly frictionally engaging the friction plates, during relative movement of the shoes and the back end of the housing towards each other;

(e) a friction wedge positioned between the shoes and protruding from the front end of the housing a distance greater than the distance which the friction plates protrude therefrom, the wedge designed to wedgingly engage and move the shoes laterally and longitudinally of the housing during relative movement of the wedge and the back end of the housing towards each other; and (f) separate spring means severally loading the friction shoes to independently exert separate spring forces substantially simultaneously against the shoes outwardly in a direction away from the back end of the housing.

2. A force resisting device, comprising:

(a) a housing having a longitudinal axis and a pair of opposing ends spaced along said axis, one of the ends being the front end of the housing and the other of the ends being the back end of the housing;

(b) a pair of movable friction plates disposed within the housing and protruding from the front end thereof, the friction plates being movable along generally parallel axes which are parallel to the longitudinal axis of the housing;

(c) a pair of friction shoes disposed within the housing inwardly of the friction plates towards the longitudinal axis of the housing, the shoes being movable laterally and longitudinally of the housing;

(d) separate means interposed between each of the shoes and adjacent movable friction plate for increasingly frictionally engaging the friction plates, during relative movement of the shoes and the back end of the housing towards each other;

(e) a friction wedge positioned between the shoes and protruding from the front end of the housing a distance greater than the distance which the friction plates protrude therefrom, the wedge designed to wedgingly engage and move the shoes laterally and longitudinally of the housing during relative movement of the wedge and the back end of the housing towards each other;

(f) a split spring seat disposed within the housing for engaging the friction plates and shoes, the split spring seat including at least two separate parts, the first of which engages at least the friction plates and the second of which engages the friction shoes;

(g) spring means engaging the first part of the at least two parts of the split ring seat for forcing the first part against the friction plates; and (h) spring means engaging the second part of the at least two parts of the split ring seat for forcing the second part against the friction shoes to maintain frictional engagement between the wedge, shoes, friction plates, and means for frictionally engaging the friction plates.

3. The force resisting device of claim 2, wherein the at least two parts of the split spring seat, comprise:

(i) a first planar plate disposed centrally of the longitudinal axis of the housing and being in a plane normal thereto, the first plate engaging the shoes; and (j) a second planar plate with a center opening, disposed outwardly of the first plate relative to the longitudinal axis of the housing, the second plate engaging the friction plate and including means for simultaneously engaging the shoes independently of the first plate.

4. The force resisting device of claim 3, wherein the shoe engaging means of the second plate, comprises at least one outstanding flange extending from the plate for engaging the shoes.

5. The force resisting device of claim 2, wherein the spring means include separate metal coil springs positioned within the housing between the back end thereof and the first and second spring parts.

6. The force resisting device of claim 2, wherein the friction shoes and the wedge have matingly sloped wedging surfaces which slidably engage, the wedging surfaces of the friction shoes and the wedging surfaces of the wedge each converging towards each other in the direction of the back end of the housing.

7. The force resisting device of claim 6, wherein each of the shoes includes a second wedging surface which is angularly disposed to the longitudinal axis of the housing, the wedging surfaces of each of the shoes converging in a direction away from the back end of the housing.

8. The force resisting device of claim 7, wherein the means for increasingly frictionally engaging the movable friction plates include a pair of substantially stationary friction plates with slightly tapered wedging surfaces for slidably engaging the wedging surfaces of the shoes, the wedging surfaces of the pair of friction plates converging in a direction towards the back end of the housing.

9. The force resisting device of claim 2, wherein each of the shoes includes at least one abutment facing the back end of the housing and against which the second part rests.

10. A force resisting device, comprising:

(a) a housing having a longitudinal axis and a pair of opposing ends spaced therealong, one of the ends being the front end of the housing and the other of the ends being the back end of the housing;

(b) a pair of movable friction plates disposed within the housing and protruding from the front end thereof, each of the friction plates being movable longitudinally of the housing and having a pair of substantially parallel planar surfaces;

(c) a pair of substantially stationary friction plates disposed within the housing inwardly of the pair of movable friction plates towards the longitudinal axis of the housing, the pair of stationary friction plates abutting the pair of movable friction plates, each of the pair of stationary friction plates having, (i) a first planar surface which slidably engages an adjacent planar surface of an adjacent movable friction plate, and (ii) a second planar wedging surface which is spaced inwardly of the first planar surface towards the longitudinal axis of the housing and which diverges from the first planar surface in the direction of the back end of the housing;

(d) a pair of friction shoes disposed within the housing inwardly of the stationary friction plates towards the longitudinal axis of the housing, the shoes abutting the stationary friction plates and being movable laterally and longitudinally of the housing, each shoe having (i) a first planar wedging surface which slidably engages an adjacent planar surface of an adjacent stationary friction plate, and (ii) a second planar wedging surface which is spaced inwardly of the first planar wedging surface of the shoe towards the longitudinal axis of the housing and which diverges from said first planar wedging surface in the direction of the back end of the housing, and (iii) at least one abutment facing rearwardly towards the back end of the housing;

(e) a friction wedge disposed within the housing between the pair of friction shoes and protruding from the front end of the housing a distance which is greater than the distance which the pair of movable friction plates protrude therefrom, the wedge including a pair of planar wedging surfaces which converge toward the back end of the housing and which slidably engage the adjacent second wedging surfaces of the friction shoes;

(f) a split spring seat positioned within the housing for engaging adjacent proximal ends of the friction shoes and pair of movable friction plates closest the back end of the housing, the split spring seat including:

(I) a first plate with a centrally disposed opening; the first plate being normal to the longitudinal axis of the housing and engaging the proximal ends of the movable friction plates and having a flange extending therefrom for engaging an adjacent abutment of each of the shoes;

(II) a second plate centrally disposed relative to the longitudinal axis of the housing and opening in the first plate for separately engaging an adjacent abutment of each of the friction shoes; and (g) separate spring means for independently forcing the plates against the movable friction plates and shoes.

11. The force resisting device of claim 10, wherein the spring means includes:

(h) a coil spring engaging the second plate and extending longitudinally therefrom within the housing towards the back end of the housing; and (i) a plurality of coil springs engaging the first plate and extending longitudinally therefrom within the housing towards the back end of the housing.

12. The force resisting device of claim 11, wherein each of the friction shoes includes a pair of abutments spaced longitudinally of the housing, the first plate engaging the abutments closest the back end of the housing and the second plate engaging the abutments closest the front end of the housing.

13. The force resisting device of claim 12, wherein the spring force against the second plate is sufficient to prevent movement of the wedge and friction shoes normally resulting when initial forces are applied against the draft gear and to provide statisfactory static and dynamic frictional capacity when parts of the device are worn.

14. The force resisting device of claim 12, wherein the spring force against the second plate is sufficient to maintain the wedge, shoes and friction plates in frictional engagement to provide substantial static and dynamic frictional capacity even when parts of the device are worn to the point of normal replacement.

* * * * *